US011141788B2

(12) United States Patent
An

(10) Patent No.: US 11,141,788 B2
(45) Date of Patent: Oct. 12, 2021

(54) METHOD FOR MANUFACTURING SINGLE-POLE ONLY USABLE MAGNET

(71) Applicant: DAE HAN SPECIAL METAL IND CO., LTD., Incheon (KR)

(72) Inventor: Jun-Bum An, Bucheon-si (KR)

(73) Assignee: DAE HAN SPECIAL METAL IND CO., LTD., Incheon (KR)

( * ) Notice: Subject to any disclaimer, the term of this patent is extended or adjusted under 35 U.S.C. 154(b) by 274 days.

(21) Appl. No.: 15/580,406

(22) PCT Filed: Jun. 27, 2017

(86) PCT No.: PCT/KR2017/006737

§ 371 (c)(1),
(2) Date: Jan. 22, 2018

(87) PCT Pub. No.: WO2018/004222

PCT Pub. Date: Jan. 4, 2018

(65) Prior Publication Data

US 2020/0030881 A1 Jan. 30, 2020

(30) Foreign Application Priority Data

Jun. 27, 2016 (KR) ..... 10-2016-0079855

(51) Int. Cl.

| | |
|---|---|
| ***B22F 7/06*** | (2006.01) |
| ***B22F 3/16*** | (2006.01) |
| ***H01F 1/08*** | (2006.01) |
| ***H01F 41/02*** | (2006.01) |

(52) U.S. Cl.

CPC ..... *B22F 7/06* (2013.01); *B22F 3/162* (2013.01); *B22F 3/168* (2013.01); *H01F 1/083* (2013.01); *H01F 1/086* (2013.01); *H01F 41/0266* (2013.01); *B22F 2301/35* (2013.01)

(58) Field of Classification Search

None

See application file for complete search history.

(56) References Cited

FOREIGN PATENT DOCUMENTS

| | | | | |
|---|---|---|---|---|
| JP | 2004-128302 | A | | 4/2004 |
| JP | 2004128302 | A | * | 4/2004 |
| JP | 2007-0214425 | A | | 8/2007 |
| KR | 20-0470862 | Y1 | | 1/2014 |
| KR | 10-2014-0112764 | A | | 9/2014 |
| KR | 20-2015-0000529 | U | | 2/2015 |

* cited by examiner

*Primary Examiner* — Anthony J Zimmer
*Assistant Examiner* — Anthony M Liang
(74) *Attorney, Agent, or Firm* — John K. Park; Park Law Firm

(57) ABSTRACT

Provided is a method of manufacturing a magnet capable of using only a single pole, whereby a combination force between a permanent (or referred to as a magnet) and a yoke (or referred to as a shielding metal) can be improved without performing a manual bonding work therebetween and then the efficiency of subsequent processes, such as polishing and plating, after combination and completeness of a product can be improved.

3 Claims, 11 Drawing Sheets

FIG. 2E
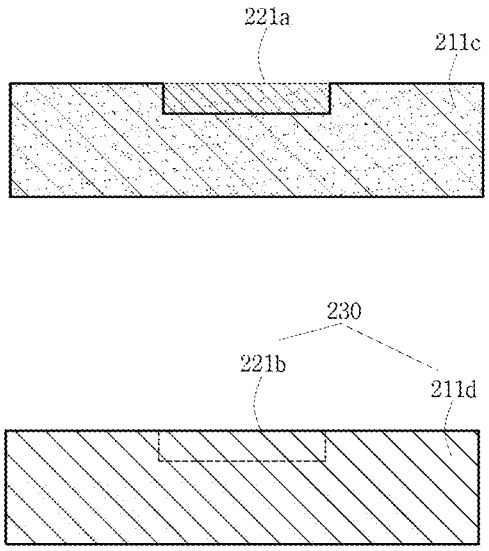
FIG. 2F
FIG. 2G
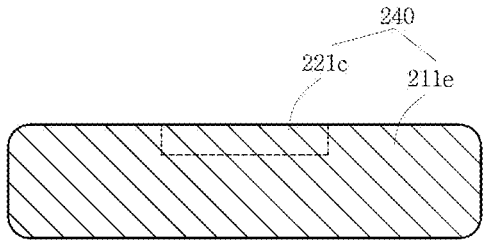

FIG. 3E
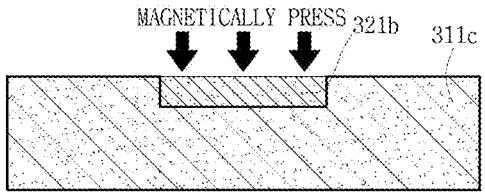
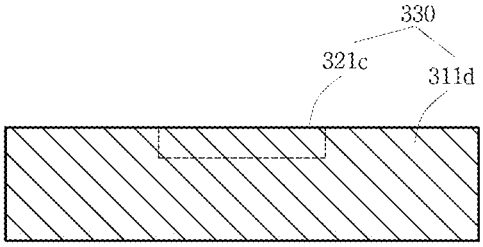
FIG. 3F
FIG. 3G
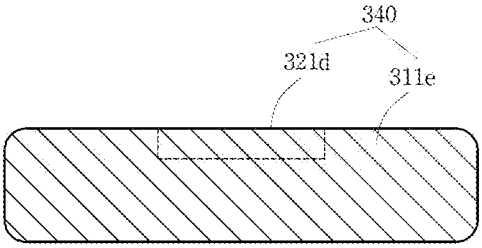

METHOD FOR MANUFACTURING SINGLE-POLE ONLY USABLE MAGNET

TECHNICAL FIELD

The present invention relates to a magnet, and more particularly, to a method of manufacturing a magnet capable of using only a single pole.

BACKGROUND ART

Magnets capable of using only a single pole are generally referred to as shielding magnets. These shielding magnets are devices, which are inserted into a case of a portable electronic device to be in contact with a hall integrated circuit (IC) of the portable electronic device so as to operate and brake the portable electronic device.

Related arts of shielding magnets include Korean Patent Laid-open Publication No. 10-2014-0112764 (published on Sep. 24, 2014, entitled as "Electronic apparatus having protection case and method of operating the same") and Korean Utility-model Registration No. 20-0470862 (registered on Jan. 8, 2014, entitled as "Mobile phone case having a shielding magnet for driving a hall IC).

The above-descried shielding magnet includes a permanent magnet and a yoke coupled to the permanent magnet, as disclosed in Korean Utility-model Registration No. 20-0470862. In such a shielding magnet, compared to specific surface Gauss of the permanent magnet, magnetic shielding of 20% to 96% occurs in a sealed pole via the yoke, and an enforced magnetic force of 105% to 180% occurs in an opened pole that does not interfere with the yoke.

However, in the conventional shielding magnet, the permanent magnet and the yoke are bonded to each other and combined with (joined to) each other via an adhesive, such as a glue. Thus, when an adhesion of the glue is deteriorated, the permanent magnet and the yoke are separated from each other. Also, because the bonding work of the permanent magnet and the yoke is manually performed, labor costs increase, and a long working time is required, which results in an increase in a unit price of a product.

DISCLOSURE OF THE INVENTION

The present invention provides a method of manufacturing a magnet capable of using only a single pole, whereby a combination force between a permanent (or referred to as a magnet) and a yoke (or referred to as a shielding metal) can be improved without performing a manual bonding work therebetween and then the efficiency of subsequent processes, such as polishing and plating, after combination and completeness of a product can be improved.

According to an aspect of the present invention, there is provided a method of manufacturing a magnet capable of using only a single pole, the method including: (a) forming a green compact having an oriented powder by magnetically pressing an alloy powder for manufacturing a magnet; (b) placing an iron-related metal powder for manufacturing a shielding metal so that at least one surface of the green compact is exposed and the remaining surfaces of the green compact are surrounded; (c) forming a compression molded body by mechanically pressing a resultant structure of (b); and (d) forming a sintered body by sintering the compression molded body.

According to another aspect of the present invention, there is provided a method of manufacturing a magnet capable of using only a single pole, the method including: (a) putting an iron-related metal powder for manufacturing a shielding metal into a predetermined mold; (b) forming a metal powder green compact having a groove with a predetermined size in a center of one surface thereof by mechanically pressing the iron-related metal powder; (c) forming an incompletely-sintered body having the groove by incompletely sintering the metal powder green compact; (d) forming an alloy powder green compact having an oriented powder to correspond to a shape of the groove by magnetically pressing the alloy powder for manufacturing a magnet; (e) inserting the alloy powder green compact into the groove of the incompletely-sintered body; and (f) forming a completely-sintered body by completely sintering a resultant structure of (e).

According to another aspect of the present invention, there is provided a method of manufacturing a magnet capable of using only a single pole, the method including: (a) putting an iron-related metal powder for manufacturing a shielding metal into a predetermined mold; (b) forming a metal powder green compact having a groove with a predetermined size in a center of one surface thereof by mechanically pressing the iron-related metal powder; (c) forming an incompletely-sintered body having the groove by incompletely sintering the metal powder green compact; (d) putting an alloy powder for manufacturing a magnet into the groove of the incompletely-sintered body; (e) magnetically pressing the alloy powder form manufacturing a magnet put into the groove; and (f) forming a completely-sintered body by completely sintering a resultant structure of (e).

According to another aspect of the present invention, there is provided a method of manufacturing a magnet capable of using only a single pole, the method including: (a) providing an alloy powder for manufacturing a magnet, a first alloy powder green compact having an oriented powder formed by magnetically pressing the alloy powder for manufacturing a magnet, or a second alloy powder green compact formed by mechanically pressing the first alloy powder green compact; (b) providing an iron-related metal powder for manufacturing a shielding metal or an incompletely-sintered body formed by incompletely sintering a metal powder green compact of the iron-related metal powder for manufacturing a shielding metal; and (c) placing a resultant structure of (a) and a resultant structure of (b) so that at least one surface of the resultant structure of (a) is exposed and the remaining surfaces of the resultant structure of (a) are surrounded by the resultant structure of (b); and (d) forming a sintered body by sintering a resultant structure of (c).

According to another aspect of the present invention, there is provided a method of manufacturing a magnet capable of using only a single pole, the method including: (a) putting an iron-related metal powder for manufacturing a shielding metal into a predetermined mold; (b) forming a metal powder green compact having a groove with a predetermined size in a center of one surface thereof by mechanically pressing the iron-related metal powder; (c) forming an incompletely-sintered body having the groove by incompletely sintering the metal powder green compact; (d) forming a first alloy powder green compact having an oriented powder to correspond to a shape of the groove by magnetically pressing the alloy powder for manufacturing a magnet within the predetermined mold; (e) manufacturing a second alloy powder green compact by mechanically pressing the first alloy powder green compact; (f) inserting the second alloy powder green compact into the groove of the incompletely-sintered body; and (g) forming a completely-sintered body by completely sintering a resultant structure of (f).

DESCRIPTION OF THE DRAWINGS

FIGS. 2A through 2G are views illustrating detailed processes of a method of manufacturing a magnet capable of using only a single pole according to another embodiment of the present invention;

FIGS. 3A through 3G are views illustrating detailed processes of a method of manufacturing a magnet capable of using only a single pole according to another embodiment of the present invention;

BEST MODE FOR CARRYING OUT THE INVENTION

The present invention will now be described more fully with reference to the accompanying drawings, in which exemplary embodiments of the invention are shown.

A method of manufacturing a magnet capable of using only a single pole according to the present invention may include: a first process of providing an alloy powder for manufacturing a magnet, a first alloy powder green compact having an oriented powder by magnetically pressing the alloy powder for manufacturing a magnet, or a second alloy powder green compact formed by mechanically pressing the first alloy powder green compact; a second process of providing an incompletely-sintered body formed by incompletely sintering an iron-related metal powder for manufacturing a shielding metal or a metal powder green compact of the iron-related metal powder for manufacturing a shielding metal; a third process of placing a resultant structure of the first process and a resultant structure of the second process so that at least one surface of the resultant structure of the first process is exposed and the remaining surfaces thereof are surrounded by the resultant structure of the second process; and a fourth process of forming a sintered body by sintering a resultant structure of the third process, and may further include: a fifth process of performing polishing, plating, and magnetization on the sintered body as a resultant structure of the fourth process.

Subsequently, specific example embodiments of the present invention will be described.

FIGS. 1A through 1F are views illustrating detailed processes of a method of manufacturing a magnet capable of using only a single pole according to an embodiment of the present invention.

Figure 1A:
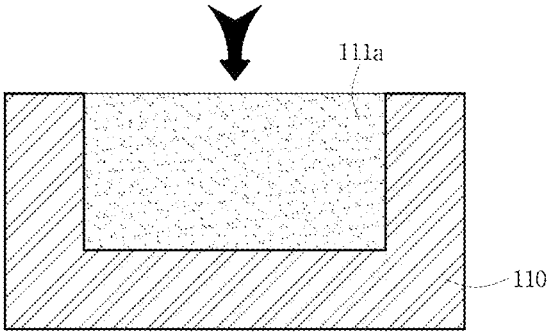
FIGS. 1A through 1F are views illustrating detailed processes of a method of manufacturing a magnet capable of using only a single pole according to an embodiment of the present invention.
Figure 1B:
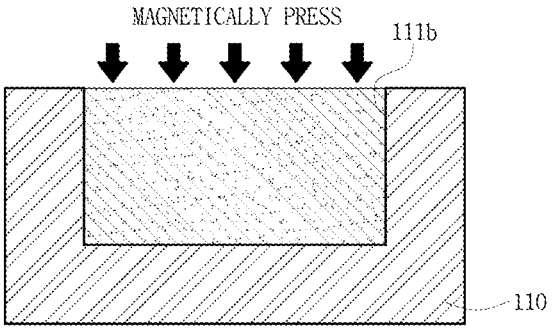

First, as illustrated in FIG. 1A, an alloy powder 111*a* for manufacturing a magnet is put into a first mold 110, and as illustrated in FIG. 1B, a magnetic field is applied to the alloy powder 111*a*, and the alloy powder 111*a* is pressed, i.e., magnetically pressed, thereby manufacturing an alloy powder green compact 111*b* having an oriented powder.

The alloy powder 111*a* for manufacturing a magnet may include a fine powder of a neodymium (Nd)-iron (Fe)-boron (B)-based magnet alloy manufactured by preparing a bulk of the Nd—Fe—B-based magnet alloy using a strip cast method, for example, and grinding the bulk into a jet mill in an inert gas.

Figure 1C:
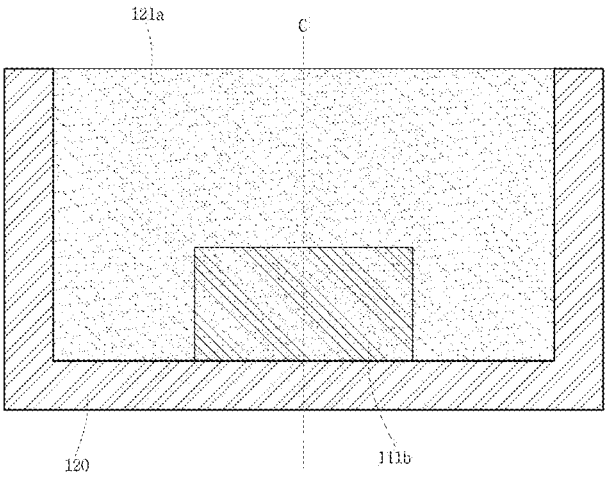

Next, as illustrated in FIG. 1C, an iron-related metal powder 121*a* for manufacturing a shielding metal is put into a second mold 120 in a state in which the center of the alloy powder green compact 111*b* is fitted to the center of a bottom surface of the second metal 120, and when the second mold 120 is removed, at least one surface (a bottom surface in the drawing) of the alloy powder green compact 111*b* is exposed, and the remaining surfaces (side surfaces and a top surface in the drawing) of the alloy powder green compact 111*b* are surrounded by the iron-related metal powder 121*a* for manufacturing the shielding metal.

Figure 1D:
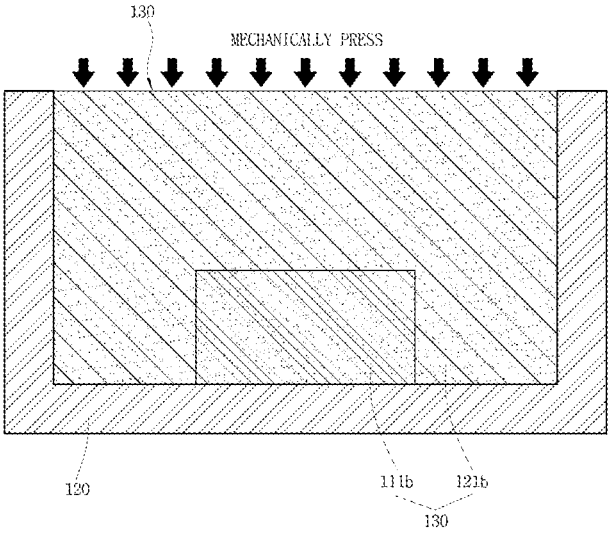

Next, as illustrated in FIG. 1D, a compression molded body 130 including the alloy powder green compact 111*b* for manufacturing a magnet and an iron-related metal powder green compact 121*b* for manufacturing a shielding metal is manufactured by mechanically pressing the resultant structure of FIG. 1C. In the current embodiment, the compression molded body 130 has a shape in which, when the second mold 120 is removed, one surface of the alloy powder green compact 111*b* for manufacturing a magnet is exposed and the remaining surfaces thereof are surrounded by the metal powder green compact 121*b*.

Figure 1E:
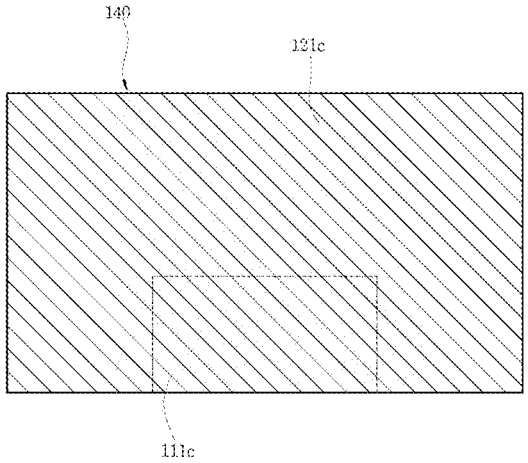

Next, as illustrated in FIG. 1E, the compression molded body 130 as the resultant structure of FIG. 1D is sintered, thereby manufacturing a sintered body 140 of the compression molded body 130 in which a sintered body 111*c* of the alloy powder green compact 111*b* for manufacturing a magnet and a sintered body 121*c* of the metal powder green compact 121*b* for manufacturing a shielding metal are integrally sintered.

For example, after a compression process including magnetic pressing and mechanical pressing is performed, a sintering and heat treatment process is performed on a base material having a relative density of about 50% to about 60% at a high temperature so that the relative density of the base material is able to be close to 95% to 100%. When the relative density of the base material increases, a residual magnetic flux density Br and a mechanical strength of the base material can be increased, and sintering may be performed on the base material about 1,300° C., and three-step (1,100° C.-950° C.-500° C.) heat treatment can be performed on the base material.

Figure 1F:
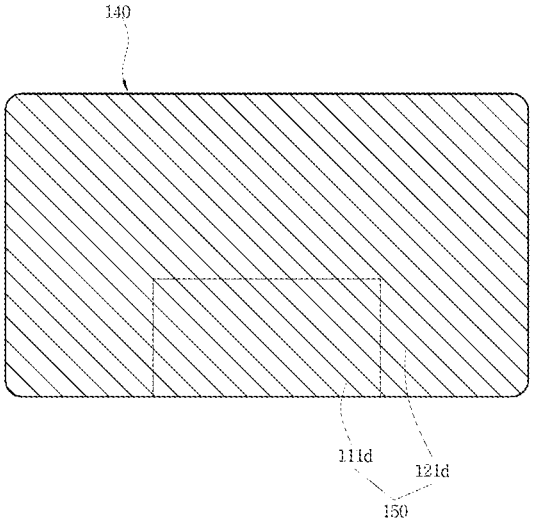

Last, as illustrated in FIG. 1F, polishing, plating, and magnetization processes are sequentially performed on a sintered body 140 as the resultant structure of FIG. 1E so that a shielding magnet 150 including a permanent magnet 111*d* having one exposed surface and a shielding metal 121*d* that surrounds the remaining surfaces of the permanent magnet 111*d* is completed. In the current embodiment, the permanent magnet 111*d* corresponds to the sintered body 111*c* of the alloy powder green compact 111*b* for manufacturing a magnet, and the above-described shielding metal 121*d* corresponds to the sintered body 121*c* of the metal powder green compact 121*b* for manufacturing a shielding magnet.

For example, a barrel polishing method may be used in the polishing process as a process of assigning R-values to a surface and edges of the product before a surface treatment process is performed. An electroplating and electroless plating method may be used as the plating process as a process of preventing oxidation and corrosion of the product, and a nickel (Ni)-copper (Cu)—Ni multilayer plating method may be performed. The thickness of a film may be 10 to 25 μm in case of Ni and 5 to 10 μm in case of zinc (Zn). The magnetization process is a magnetization work of aligning magnetic spins in a predetermined direction by applying an external magnetic field to the product, and a magnetic-field strength of 1.5 to 3 times of coercivity of the product is required to be applied to the product so that saturation magnetization can be implemented (a work needs to be performed at 1500 volt/2,000 μF or higher.).

In the current embodiment, external shapes of the permanent magnet 111*d* and the shielding metal 121*d* may be changed according to the shapes of the first mold 110 and the second mold 120.

FIGS. 2A through 2G are views of illustrating detailed processes of a method of manufacturing a magnet capable of using only a single pole according to another embodiment of the present invention.

Figure 2A:
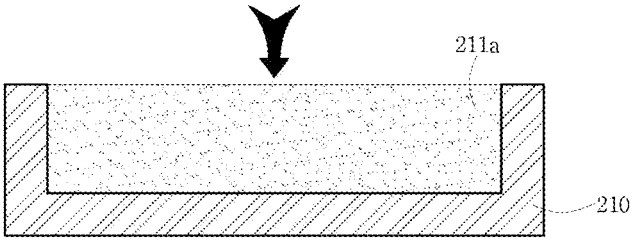
Figure 2B:
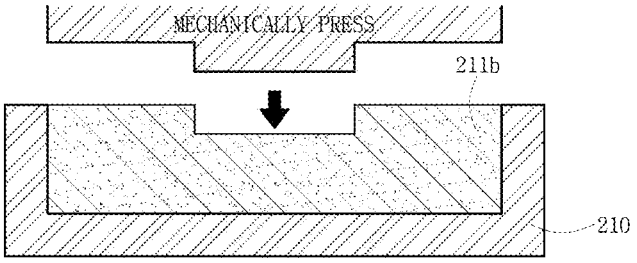

First, as illustrated in FIG. 2A, an iron-related metal powder 211*a* for manufacturing a shielding metal is put into the first mold 210, and as illustrated in FIG. 2B, the iron-related metal powder 211*a* is mechanically pressed so that a metal powder green compact 211*b* having a groove with a predetermined size in the center of one surface thereof can be formed.

Figure 2C:
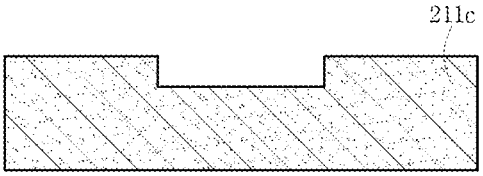

Subsequently, as illustrated in FIG. 2C, the metal powder green compact 211*b* is sintered (is not completely sintered but is incompletely sintered) so that an incompletely-sintered body 211*c* having a groove can be formed. Incomplete sintering may be performed by adjusting relative sintering temperature and time compared to complete sintering.

Figure 2D:
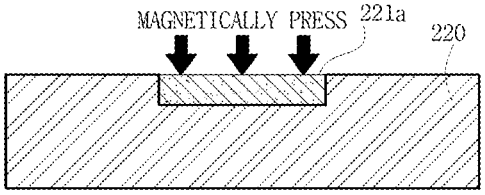

As illustrated in FIG. 2D, the alloy powder for manufacturing a magnet in the second mold 220 is magnetically pressed so that an alloy powder green compact 221*a* having an oriented powder can be manufactured to have a shape corresponding to the groove of the incompletely-sintered body 211*c*. A manufacturing method thereof may be the same as the processes of FIGS. 1A and 1B.

Subsequently, as illustrated in FIG. 2E, after the alloy powder green compact 221*a* of FIG. 2D is inserted into the groove formed in the incompletely-sintered body 211*c* of FIG. 2C using press fitting, as illustrated in FIG. 2F, the resultant structure of FIG. 2E is completely sintered, thereby manufacturing a sintered body 230 in which a completely-sintered body 221*b* of the alloy powder green compact 221*a* for manufacturing a magnet and a completely-sintered body 211*d* of the incompletely-sintered body 211*c* of the iron-related metal powder green compact 211*b* for manufacturing a shielding metal are integrally sintered. Complete sintering may be performed by adjusting relative sintering temperature and time compared to incomplete sintering. The resultant structure of FIG. 2E is pressed and then can be completely sintered in FIG. 2F.

Last, as illustrated in FIG. 2G, polishing, plating, and magnetization processes may be sequentially performed on the (completely-) sintered body 230 as the resultant structure of FIG. 2F so that a shielding magnet 240 including the permanent magnet 221*c* having one exposed surface and a shielding metal 211*e* that surrounds the remaining surfaces of the permanent magnet 221*c* can be manufactured. In the current embodiment, the permanent magnet 221 corresponds to the completely-sintered boy 221*b* of the alloy powder green compact 221*a* for manufacturing a magnet, and the shielding metal 211*e* corresponds to the completely-sintered body 211*d* of the incompletely-sintered body 211*c* of the iron-related metal powder green compact 211*b* for manufacturing the shielding metal.

For example, a barrel polishing method may be used in the polishing process as a process of assigning R-values to a surface and edges of the product before a surface treatment process is performed. An electroplating and electroless plating method may be used as the plating process as a process of preventing oxidation and corrosion of the product, and a Ni—Cu—Ni multilayer plating method may be performed. The thickness of a film may be 10 to 25 μm in case of Ni and 5 to 10 μm in case of zinc (Zn). The magnetization process is a magnetization work of aligning magnetic spins in a predetermined direction by applying an external magnetic field to the product, and a magnetic-field strength of 1.5 to 3 times of coercivity of the product is required to be applied to the product so that saturation magnetization can be implemented (a work needs to be performed at 1500 volt/2,000 μF or higher.).

In order to adjust surface flatness after the processes of FIG. 2F are performed, a mechanical pressing process may be performed so that a planarization process of the surface of the completely-sintered body 230 can be further performed.

In the current embodiment, external shapes of the shielding metal 211*e* and the permanent magnet 221*c* may be changed according to the shapes of the first metal 210 and the second metal 220.

FIGS. 3A through 3G are views illustrating detailed processes of a method of manufacturing a magnet capable of using only a single pole according to another embodiment of the present invention.

Figure 3A:
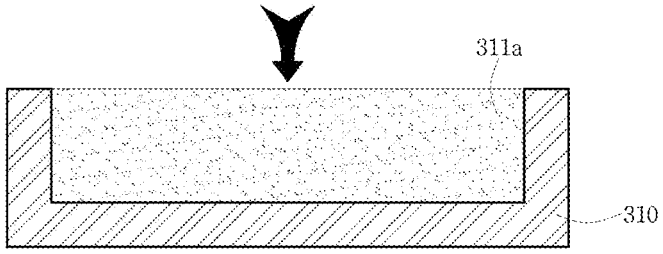
Figure 3B:
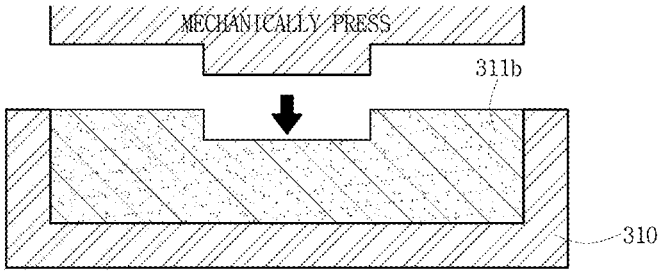

First, as illustrated in FIG. 3A, an iron-related metal powder 311*a* for manufacturing a shielding metal is put into a first mold 310, and as illustrated in FIG. 3B, the iron-related metal powder 311*a* is mechanically pressed so that a metal powder green compact 311*b* having a groove with a predetermined size in the center of one surface thereof can be formed.

Figure 3C:
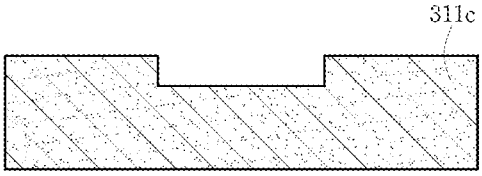

Subsequently, as illustrated in FIG. 3C, the metal powder green compact 311*b* is sintered (is not completely sintered but is incompletely sintered), thereby forming an incompletely-sintered body 311*c* having a groove. Incomplete sintering may be performed by adjusting relative sintering temperature and time compared to complete sintering.

Figure 3D:
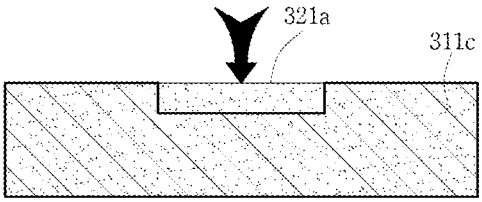

Subsequently, as illustrated in FIG. 3D, an alloy powder 321*a* for manufacturing a magnet is put into a groove formed in the incompletely-sintered body 311*c* as the resultant structure of FIG. 3C, and as illustrated in FIG. 3E, the alloy powder 321*a* for manufacturing a magnet is magnetically pressed so that an alloy powder green compact 321*b* having an oriented powder can be formed.

Subsequently, as illustrated in FIG. 3F, the resultant structure of FIGS. 3D and 3E is completely sintered so that a (completely-) sintered body 330 in which a completely-sintered body 321*c* of the alloy powder green compact 321*b* for manufacturing a magnet and a completely-sintered body 311*d* of an incompletely-sintered body 311*c* of the iron-related metal power green compact 311*b* for manufacturing a shielding metal are integrally sintered, can be manufactured. Complete sintering may be performed by adjusting relative sintering temperature and time compared to incomplete sintering. The resultant structure of FIGS. 3D and 3E is mechanically pressed and then can be completely sintered in FIG. 3F.

Last, as illustrated in FIG. 3G, polishing, plating, and magnetization processes are sequentially performed on the sintered body 330 as the resultant structure of FIG. 3F so that a shielding magnet 340 including a permanent magnet 321*c* having one exposed surface and a shielding metal 311*e* that surrounds the remaining surfaces of the permanent magnet 321*c* is completed. In the current embodiment, the permanent magnet 321*c* corresponds to the completely-sintered body 321*c* of the alloy powder green compact 321*b* for manufacturing a magnet, and the shielding metal 311*e* corresponds to the completely-sintered body 311*d* of the incompletely-sintered body 311*c* of the iron-related metal powder green compact 311*b* for manufacturing a shielding magnet.

For example, a barrel polishing method may be used in the polishing process as a process of assigning R-values to a surface and edges of the product before a surface treatment process is performed. An electroplating and electroless plating method may be used as the plating process as a process of preventing oxidation and corrosion of the product, and a nickel (Ni)-copper (Cu)—Ni multilayer plating method may be performed. The thickness of a film may be 10 to 25 μm in case of Ni and 5 to 10 μm in case of zinc (Zn). The magnetization process is a magnetization work of aligning magnetic spins in a predetermined direction by applying an external magnetic field to the product, and a magnetic-field strength of 1.5 to 3 times of coercivity of the product is required to be applied to the product so that saturation magnetization can be implemented (a work needs to be performed at 1500 volt/2,000 μF or higher.).

In order to adjust surface flatness after the processes of FIG. 3F are performed, a mechanical pressing process may be performed so that a planarization process of the surface of the completely-sintered body 330 can be further performed.

In the current embodiment, external shapes of the shielding magnet 211*e* may be changed according to the shapes of the first mold 310, and the iron-related metal powder 311*a* may be mechanically pressed in the process of FIG. 3B so that the external shapes of the permanent magnet 221*c* can be changed according to the shape of a groove formed in the center of one surface of the metal powder green compact 311*b*.

FIGS. 4A through 4I are views illustrating detailed processes of a method of manufacturing a magnet capable of using only a single pole according to another embodiment of the present invention.

Figure 4A:
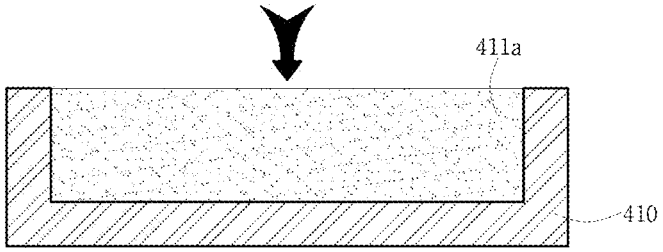
FIGS. 4A through 4I are views illustrating detailed processes of a method of manufacturing a magnet capable of using only a single pole according to another embodiment of the present invention.
Figure 4B:
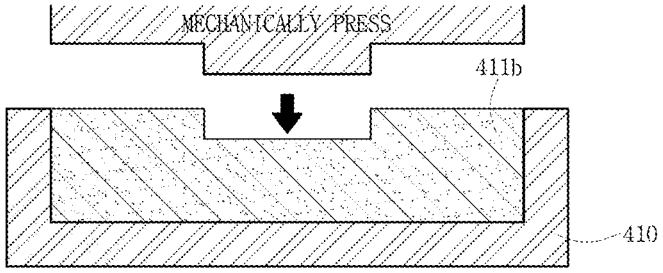

First, as illustrated in FIG. 4A, an iron-related metal powder 411*a* for manufacturing a shielding metal is put into a first mold 410, and as illustrated in FIG. 4B, the iron-related metal powder 411*a* is mechanically pressed so that a metal powder green compact 411*b* having a groove with a predetermined size in the center of one surface thereof can be formed.

Figure 4C:
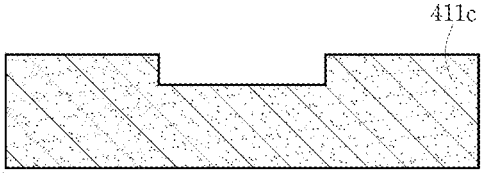

Subsequently, as illustrated in FIG. 4C, the metal powder green compact 411*b* is sintered (is not completely sintered but is incompletely sintered) so that an incompletely-sintered body 411*c* having a groove can be formed. Incomplete sintering may be performed by adjusting relative sintering temperature and time compared to incomplete sintering, and the incompletely-sintered body has a predetermined tension.

Figure 4D:
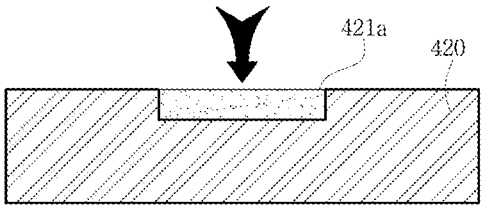
Figure 4E:
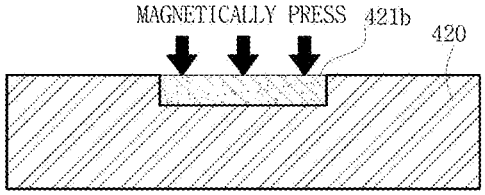
Figure 4F:
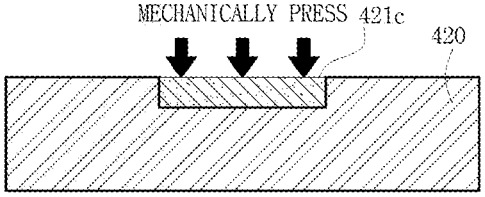

As illustrated in FIG. 4D, an alloy powder 421*a* for manufacturing a magnet is put into a second mold 430, and as illustrated in FIG. 4E, the alloy powder 421*a* is magnetically pressed so that a first alloy powder green compact 421*b* having an oriented powder can be formed. Then, as illustrated in FIG. 4F, the first alloy powder green compact 421*b* is mechanically pressed so that a second alloy powder green compact 421*c* can be manufactured. The second alloy powder green compact 421*c* has a shape corresponding to the groove of the incompletely-sintered body 411*c*.

Figure 4G:
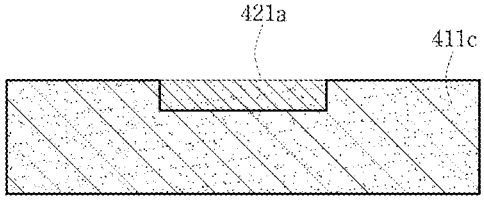
Figure 4H:
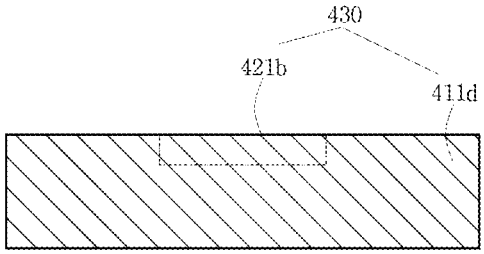

Subsequently, as illustrated in FIG. 4G, after the second alloy powder green compact 421*c* of FIG. 4F is inserted into the groove formed in the incompletely-sintered body 411*c* of FIG. 4*c* and then, as illustrated in FIG. 4H, the resultant structure of FIG. 4G is completely sintered so that a (completely-) sintered body 430 in which a completely-sintered body 421*d* of the alloy powder green compact 421*c* for manufacturing a magnet and a completely-sintered body 411*d* of the incompletely-sintered body 411*c* of the iron-related metal powder green compact 411*b* for manufacturing a shielding metal are integrally sintered, can be manufactured. Incomplete sintering may be performed by adjusting relative sintering temperature and time compared to incomplete sintering.

Figure 4I:
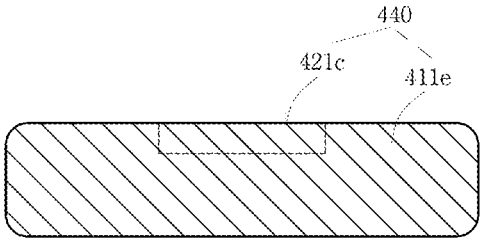

Last, as illustrated in FIG. 4I, polishing, plating, and magnetization processes are sequentially performed on the (completely-) sintered body 430 as the resultant structure of FIG. 4H so that a shielding metal 440 including a permanent magnet 421*e* having one exposed surface and a shielding metal 411*e* that surrounds the remaining surfaces of the permanent magnet 421*e* can be manufactured. In the current embodiment, the permanent magnet 421*e* corresponds to the completely-sintered body 421*d* of the alloy powder green compact 421*c* for manufacturing a magnet, and the shielding metal 411*e* corresponds to the completely-sintered body 411*d* of the incompletely-sintered body 411*c* of the iron-related metal powder green compact 411*b* for manufacturing a shielding metal.

For example, a barrel polishing method may be used in the polishing process as a process of assigning R-values to a surface and edges of the product before a surface treatment process is performed. An electroplating and electroless plating method may be used as the plating process as a process of preventing oxidation and corrosion of the product, and a Ni—Cu—Ni multilayer plating method may be performed. The thickness of a film may be 10 to 25 μm in case of Ni and 5 to 10 μm in case of zinc (Zn). The magnetization process is a magnetization work of aligning magnetic spins in a predetermined direction by applying an external magnetic field to the product, and a magnetic-field strength of 1.5 to 3 times of coercivity of the product is required to be applied to the product so that saturation magnetization can be implemented (a work needs to be performed at 1500 volt/2,000 μF or higher.).

In order to adjust surface flatness after the processes of FIG. 4H are performed, a mechanical pressing process may be performed so that a planarization process of the surface of the completely-sintered body 230 can be further performed.

In the current embodiment, external shapes of the shielding metal 411*e* and the permanent magnet 421*e* may be changed according to the shapes of the first mold 410 and the second mold 420.

Figure 5A:
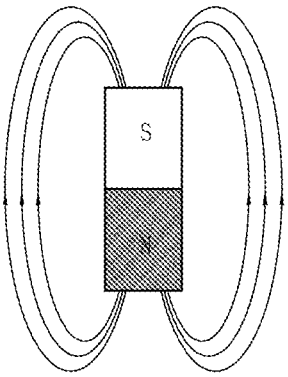
FIGS. 5A through 5C are views of the flow of a magnetic field of a general permanent magnet and the flow of a magnetic field of a permanent magnet having a yoke combined thereto, respectively.
Figure 5B:
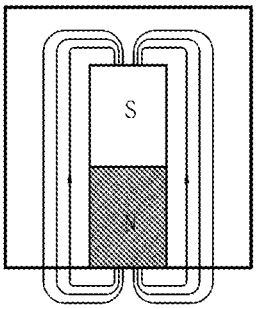
Figure 5C:
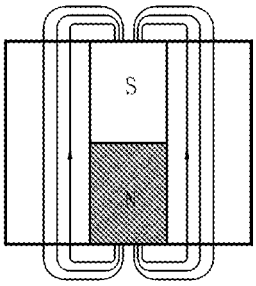

FIGS. 5A through 5C are views of the flow of a magnetic field of a general permanent magnet and the flow of a magnetic field of a permanent magnet having a yoke (shielding metal) combined thereto, respectively.

In the permanent magnet, a magnetic line is formed in a fully-opened state, as illustrated in FIG. 5A. However, when the permanent magnet is sealed by a metal yoke having high permeability, the magnetic line as illustrated in FIGS. 5B and 5C appears in the permanent magnet according to the shape of the yoke.

That is, in the magnetic field of the permanent magnet, an attractive force and a repulsive force are differently generated according to a metal, and degrees thereof varies according to permeability of the metal. When a metal having high permeability is close to the permanent magnet, the flow of the magnetic field is changed. Also, when the metal is close to the permanent magnet after the shape and the thickness of the metal are properly designed, directivity of the magnetic field through induction of the flow of the magnetic field can be changed.

Thus, the yoke can be integrally combined with the permanent magnet by changing the material, thickness and shape of the yoke according to the degree of reinforcement of a required magnetic force and the degree of shielding. Thus, a reinforcement ratio and a shielding ratio of the shielding magnet can be changed.

Thus, like in the above-described embodiment of the present invention, a shielding magnet 150, 240, 340 or 440 including a permanent magnet 111*d*, 221*c*, 321*d*, or 421*e* having one exposed surface and the remaining surfaces surrounded by a shielding metal 121*d*, 211*e*, 311*e*, or 411*e* as a yoke may generate the magnetic line illustrated in FIG. 5B and thus may be used as a magnet capable of using only a single pole.

As described above, according to the present invention, because combination of an alloy powder for manufacturing a magnet that constitutes a permanent magnet (magnet) and a yoke (a shielding metal) and an iron-related metal powder for manufacturing a shielding metal is performed during processes (for example, compression, sintering, etc.) required to manufacture a magnet, a combination force therebetween can be greatly increased without additionally performing an existing manual bonding work, and a shielding magnet, i.e., a magnet capable of using only a single pole, as a final base material is formed as one sintered body so that the efficiency of subsequent processes such as polishing, plating and magnetization after sintering and the completeness of the product can be improved.

Thus, compared to a conventional shielding magnet in which a permanent magnet and a yoke are bonded to each other using an additional manual work and are combined with (joined to) each other, an adhesion can be greatly improved, and labor costs and a working time can be greatly reduced, the unit price of the product can be reduced, and the efficiency of a manufacturing process and the completeness of the product can be improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A method of manufacturing a magnet capable of using only a single pole, the method comprising:

(a) forming a green compact having an oriented powder by magnetically pressing an alloy powder for manufacturing a magnet;

(b) placing an iron-based metal powder for manufacturing a shielding metal so that at least one surface of the green compact is exposed and the remaining surfaces of the green compact are surrounded;

(c) forming a compression molded body by mechanically pressing a resultant structure of (b); and (d) forming a sintered body by sintering the compression molded body.

2. The method of claim 1, wherein (b) comprises:

(b-1) placing the green compact in a center of a bottom of a predetermined mold; and (b-2) putting the iron-based metal powder into the predetermined mold in a state of (b-1).

3. The method of claim 1, further comprising (e) performing polishing, plating and magnetization on the sintered body.

* * * * *